US005207718A

United States Patent [19]

Glover et al.

[11] Patent Number: 5,207,718

[45] Date of Patent: May 4, 1993

[54] SLACKLESS DRAWBAR

[75] Inventors: Mary A. Glover, Pittsburgh; Peter S. Mautino, Verona, both of Pa.

[73] Assignee: McConway & Torley Corporation, Pittsburgh, Pa.

[21] Appl. No.: 855,521

[22] Filed: Mar. 23, 1992

[51] Int. Cl.[5] ..... B61G 9/00

[52] U.S. Cl. ..... 213/62 R; 213/50; 213/50.5; 213/56

[58] Field of Search ..... 213/50, 50.2, 51, 56, 213/57, 58, 60, 61, 62 R, 62 A, 63, 67 R, 69, 70, 71, 72

[56] References Cited

U.S. PATENT DOCUMENTS

| | | | |
|---|---|---|---|
| 4,422,557 | 12/1983 | Altherr | 213/62 R |
| 4,456,133 | 6/1984 | Altherr et al. | 213/69 |
| 4,549,666 | 10/1985 | Altherr et al. | 213/69 |
| 4,580,686 | 4/1986 | Elliott | 213/62 A |
| 4,593,827 | 6/1986 | Altherr | 213/62 R |
| 4,681,040 | 7/1987 | Brodeur et al. | 213/62 R |
| 4,863,045 | 9/1989 | Altherr | 213/62 A |
| 4,966,291 | 10/1990 | Glover | 213/62 A |
| 5,002,192 | 3/1991 | Kaufhold | 213/50.5 |
| 5,097,973 | 3/1992 | Spencer | 213/50 |

FOREIGN PATENT DOCUMENTS

| | | | |
|---|---|---|---|
| 0594689 | 5/1959 | Italy | 213/61 |

*Primary Examiner*—Mark T. Le

*Attorney, Agent, or Firm*—James Ray & Associates

[57] ABSTRACT

A drawbar for a slackless drawbar system comprises an elongated bar having a load support portion adjacent its one end for connection to one of a pair of adjacent cars in a train, a pin receiving opening extending through the load support portion, a hemispherical recess extending partially around the pin receiving opening and a pin bearing having a hemispherical outer surface receivable in the hemispherical recess and a cylindrical inner surface to receive a pin. The pin bearing preferably is constructed of two symmetrical halves retained in the hemispherical recess by a retaining clip of spring material and the pin receiving opening is provided with a recess to receive the pin bearing retaining clip. The drawbar is provided with a second load support portion at its other end which may be the same as the load support portion at its one end or which may be different if required to connect to a railway car with a different form of coupling.

18 Claims, 7 Drawing Sheets

SLACKLESS DRAWBAR

FIELD OF THE INVENTION

This invention relates to drawbars and in particular to drawbars utilized in slackless drawbar systems which have fixed pivot pins. The invention will be described and illustrated in a railway application and more specifically as a component for a railway slackless drawbar system. In this application the drawbars are commonly used to connect cars in a dedicated service such as a coal or ore operation or container service. In these applications it is not necessary to provide standard Association of American Railroads (AAR) couplers and/or draft gear since the cars are only rarely uncoupled but it is desirable to avoid impact due to the take-up of slack which can cause damage to equipment and/or lading.

CROSS-REFERENCE TO RELATED APPLICATIONS

A co-pending application relating to this application is U.S. patent application Ser. No. 07/855,439, filed Mar. 23, 1992 "SLACKLESS DRAWBAR SYSTEM". The patent application is assigned to the assignee of the present invention. The disclosure contained therein is incorporated herein by reference.

BACKGROUND OF THE INVENTION

The avoidance of shock loads caused by the take-up of slack between cooperating elements of a coupling system through which draft and buff loads are applied to a train has long been a concern of railway operators. In some dedicated train operations it is advantageous to avoid the weight and cost of standard AAR couplers and draft gear by replacing them with light weight, simple drawbars but this means that slack take-up and impact dissipation systems included in the deleted equipment are also eliminated. Therefore it has been a goal in designing drawbar systems to eliminate slack. It is also desirable to keep the apparatus light in weight, strong enough to withstand maximum draft and buff loads and flexible enough to handle side to side and fore and aft angling as required by AAR rules.

Slackless systems have been provided before. For example, U.S. Pat. No. 4,580,686 illustrates a wedge-shaped slack take-up member and U.S. Pat. No. 4,996,291 shows a rotary drawbar system. The disclosures of the above patents are incorporated herein by reference and made a part of this disclosure.

SUMMARY OF THE INVENTION

This invention provides improvements over U.S. Pat. Nos. 4,580,686 and 4,996,291. The present invention is a drawbar for a slackless drawbar system. The drawbar is comprised of an elongated bar having a butt end, a load support portion, a pin receiving opening which extends through the load support portion, a hemispherical recess which extends partially around the pin receiving opening and a pin bearing or pin bearing block which is supported and retained in the hemispherical recess by a retaining clip. The butt end of the drawbar engages a follower which in turn is in contact with a slack take-up wedge which holds the follower in close contact with the butt end of the drawbar. A draft stop or other connecting element provides a final connection between the slack take-up wedge and the center sill of a railway car to handle buff forces. Further, the pin bearing has an outer surface which closely matches the hemispherical recess in the pin receiving opening, while the pin bearing's inner surface has a cylindrical shape to pivotally receive a pin which connects the drawbar through a suitable yoke or other connecting element to the center sill of a railway car to apply draft force.

The pin bearing block of the present invention is comprised of two substantially symmetrical halves. The two halves can be retained in the hemispherical recess by a retaining clip. The retaining clip is received in a retaining clip recess which extends around the portion of the pin receiving opening which is not occupied by the hemispherical recess. In essence, the retaining clip recess holds the retaining clip in position to contact the pin bearing block and help hold it in proper position to receive the pin. It has been found that the drawbar will have improved stress handling characteristics if the hemispherical recess for the bearing block is extended over an arc of at least 180°.

This invention provides a drawbar system which avoids shocks and excess loads caused by slack, yet is lighter in weight and is capable of handling the same maximum draft and buff loads as previously known apparatus.

OBJECTS OF THE INVENTION

It is an object of the invention to provide a drawbar for a slackless drawbar system that can be readily applied to a standard railway car with a minimum amount of modification of the car. Another object of the invention is to provide a slackless drawbar which offers a substantial savings in weight over conventional drawbars presently used in standard AAR coupler and draft gear systems.

It is also an object of this invention to provide a slackless drawbar which avoids slack in both draft and buff modes.

Still another object of this invention is to provide a drawbar to be incorporated into a slackless drawbar system which has been designed to avoid high stress concentrations and to resist wear in high wear areas thereby providing reliability and long life.

Yet another object is to provide a drawbar which can be used as a transition member to connect two railway cars equipped with different types of coupling systems.

These and other objects and advantages will become apparent from the attached drawings and written description.

DESCRIPTION OF THE PREFERRED EMBODIMENT

Figure 1:
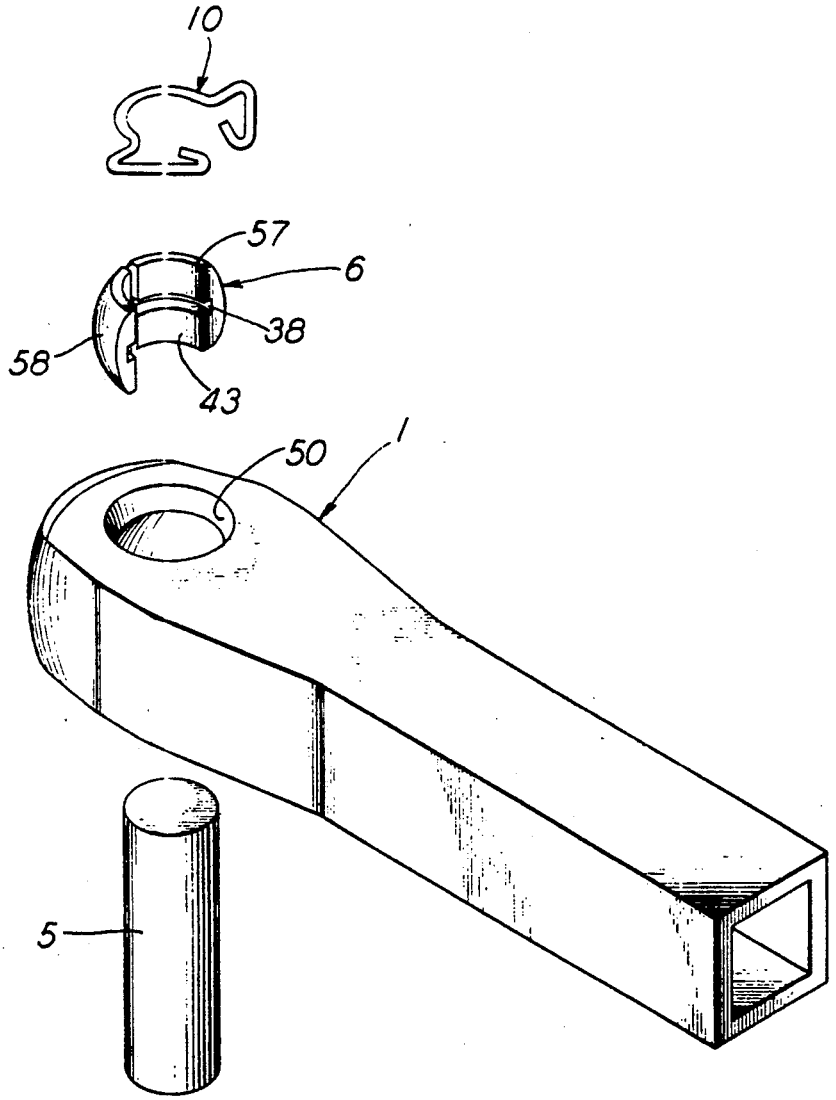
FIG. 1 is an exploded view of the elements of a slackless drawbar constructed in accordance with the invention.

As can be seen in the drawings the slackless drawbar 1 is connected to a yoke (not shown) or other connecting element 2 which in turn is fastened to the center sill 11 of a railway car (not shown). The butt or inner end 12 of drawbar 1 is in contact with a follower 3 which is held in close contact with the butt end 12 of the drawbar by a slack take-up wedge 4. Slack take-up wedge 4 is held in its position along the railway car center sill by member 65 which may be the back wall of connecting element 2 or some other form of draft stop rigidly secured to center sill 11. Buff force is applied from a railway car to slackless drawbar 1 through the connecting element 2, wedge 4 and follower 3 to the butt end 12 of the drawbar. Follower 3 and wedge 4 have cooperating oppositely inclined faces 15 and 16 respectively which allow the wedge 4 to drop by gravity to compensate for slack in the drawbar system. The angle of the inclined faces is selected to permit easy downward movement of the wedge by gravity but to inhibit upward motion particularly under buff loads. This angle is approximately 14°. The wedge 4, follower 3 and support casting 2 are constructed and arranged so that about one inch of slack can be compensated for without detrimental effect on the load carrying capabilities of the drawbar system. When this limit is reached, the wedge can be removed and replaced with a wedge of the same configuration except that the thickness of the wedge at any given point between the inclined face 16 and the vertical face 19 will be greater than the corresponding thickness of the wedge being replaced. The bearing block 6 is held in position within slackless drawbar 1 by a retaining clip 10. As can be seen in the drawings, the inner surface 43 of bearing block 6 has an arcuate groove 38. When bearing block 6 is in position within drawbar 2, groove 38 is in registry with a groove or recess 39 which extends around the circumferential portion of the inner surface of opening 50 not occupied by annular recess 32. Bearing block 6 can more easily be inserted in the opening 50 when it is made in two parts.

Retaining clip 10 is made of wire spring material and is generally symmetrical. It has a semicircular bight portion 40, diverging offset portions 41, 42 providing shoulders which help hold the two parts 57, 58 of bearing block 6 in a position substantially centered in the recess 32, rectilinear portions 51, 52 which are connected by relatively sharp bends 55, 56 respectively to the offset portions 41, 42 and impinge against complementary rectilinear portions 59, 60 of the groove thereby creating a spring bias urging bearing block 6 into position against recess 32. Finally, retaining clip 10 includes sharply bent end portions 53, 54 which provide means for engaging the clip for compression and removal and prevent binding of the clip in groove 39. The slackless drawbar assembly is attached to the car preferably by welding or otherwise attaching connecting element 2 to the center sill of the car. Connecting element 2 may be the support casting disclosed in copending application Ser. No. 07/855,439 but is not limited thereto.

Inclined surfaces 28, 29 are provided at the bottom and top respectively of the inner end 12 of the slackless drawbar 1 to permit rocking of the end of the drawbar about a horizontal axis within the connecting member 2.

Inclined surfaces 33, 34, 35 and 36 are provided at the load support portion 49 of the slackless drawbar 1 to permit relative swinging motion about pin 5 when a car to which the slackless drawbar 1 is attached negotiates a curve.

The portion 48 of the slackless drawbar 1 intermediate its ends is preferably tubular to reduce weight while the load support portion and butt ends are of solid material. The load support portion 49 of the slackless drawbar 1 has an opening 50 extending therethrough of a diameter larger than pin 5. Opening 50 is generally elliptical in horizontal cross-section and has an annular recess extending around approximately one-half the circumference of opening 50 nearest butt end 12 of the slackless drawbar 1. This recess is shaped and sized to receive the outer spherical surface 37 of bearing block 6. The opening 50 of the slackless drawbar 1 is flared adjacent its ends to permit rocking motion of slackless drawbar 1 with respect to the vertical axis of pin 5.

It is obvious that a transition or interconnection drawbar can be made which has one end constructed and arranged to be connected to a railway car fitted with slackless draft systems of the type illustrated herein and its other end constructed and arranged for connection to a railway car fitted with a different form of draft systems (not shown) such as a standard AAR coupler and draft gear or a rotary type coupling which allows side dumping of a railway car. Such a drawbar would allow a semi-permanently coupled set of cars to be inserted in a train with conventional coupling or with cars designed for rotary dumping.

The slackless drawbar of this invention was designed and constructed to produce superior performance and results under load conditions required by AAR for standard couplers so that the improved drawbar can be used in a train with conventionally coupled cars. Therefore stress analysis was made with draft loads of at least about 900,000 lbs. and buff loads of at least about 1,200,000 lbs. Complete stress analyses of the drawbar were done using a system of analysis known as Finite Element Analysis (FEA).

Materials for the slackless drawbar and related components were selected to provide the best results based on the forces to be withstood, type of use and exposure to wear. Weight is important in railway and other transportation applications and efforts were made to keep weight at a minimum consistent with the need to meet strength and wear requirements.

In the preferred embodiment the slackless drawbar 1 is made of AAR Grade "E" steel and has a weight of about 690 lbs. The follower and wedge are also made of AAR Grade "E" steel and weigh about 45 lbs. and 49 lbs. respectively. The pin can be a 3½ inch diameter AISI 1080 or AISI 8620 steel pin weighing about 33 lbs.

The follower and butt end 12 of the drawbar will be subject to high wear. These areas are preferably flame hardened to provide better wear characteristics. The bearing block is preferably made of two symmetrical quarter-spherical sections constructed of a high compressive wear resistant material such as Austempered Ductile Iron. This material has high compressive strength but retains ductility and has a relatively short wear-in period while retaining long overall wear-life. The bearing block weighs a total of about 11 lbs. The bearing block retaining clip is preferably made of corrosion resistant spring material such as ASTM 302 stainless steel.

Figure 10:
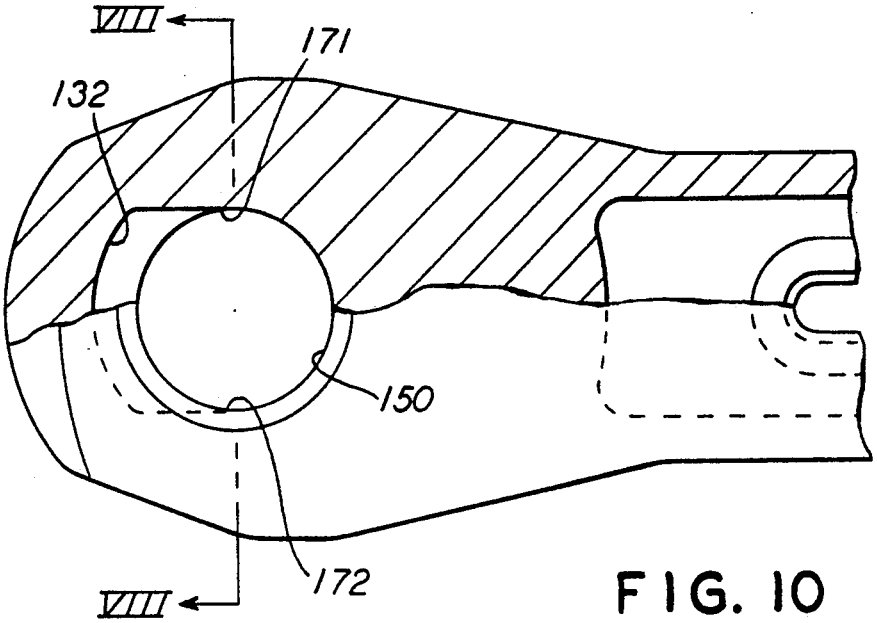
FIGS. 8, 9 and 10 are views of a prior art drawbar comparable respectively to the views of the invention shown in FIGS. 6, 7 and 2.
Figure 2:
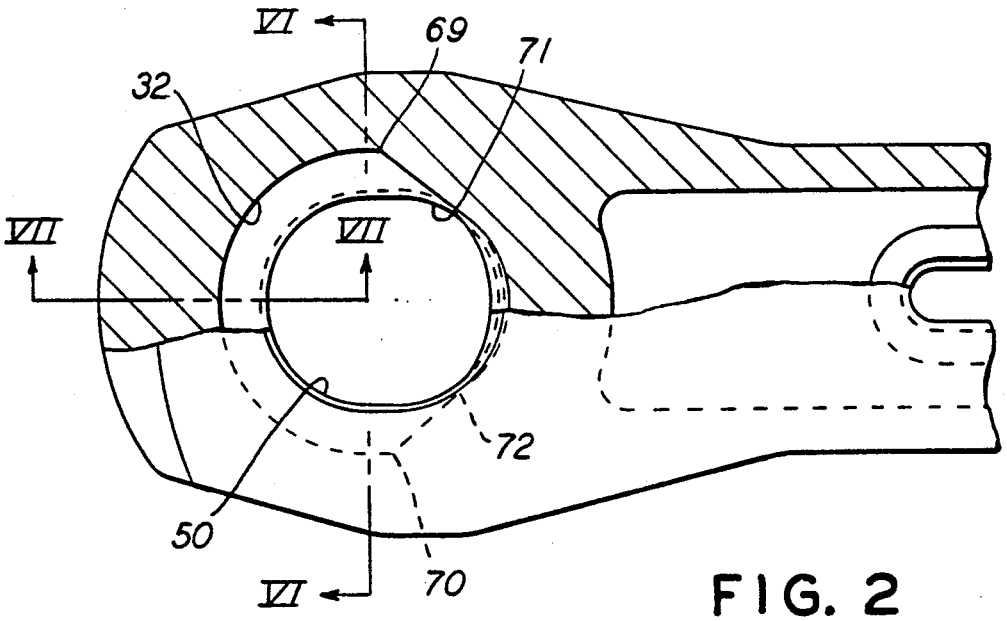
FIG. 2 is a detailed plan view, partly in cross-section of one end of the drawbar.
Figure 3:
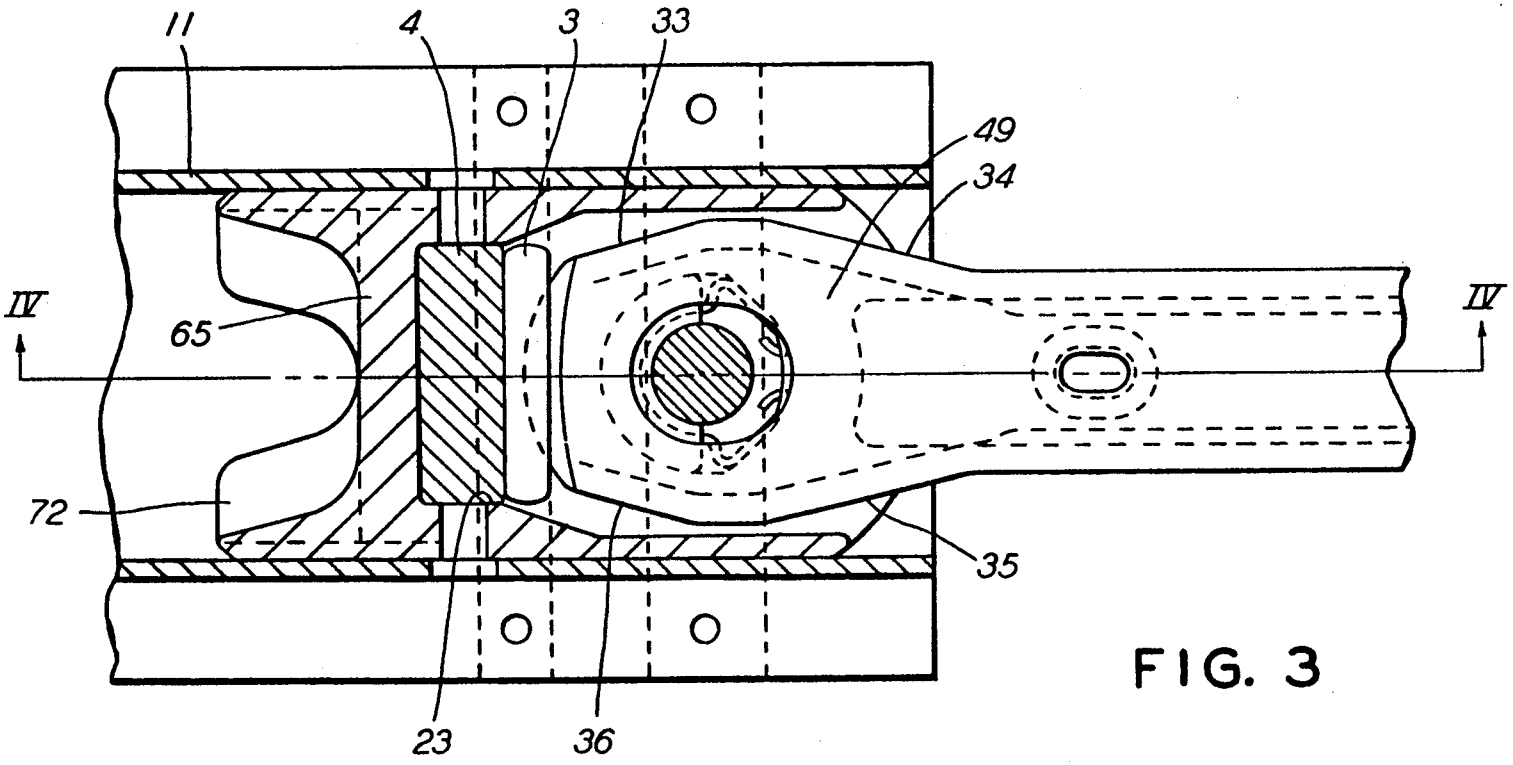
FIG. 3 is a cross-sectional view of the drawbar taken along the line III—III in FIG. 4.
Figure 4:
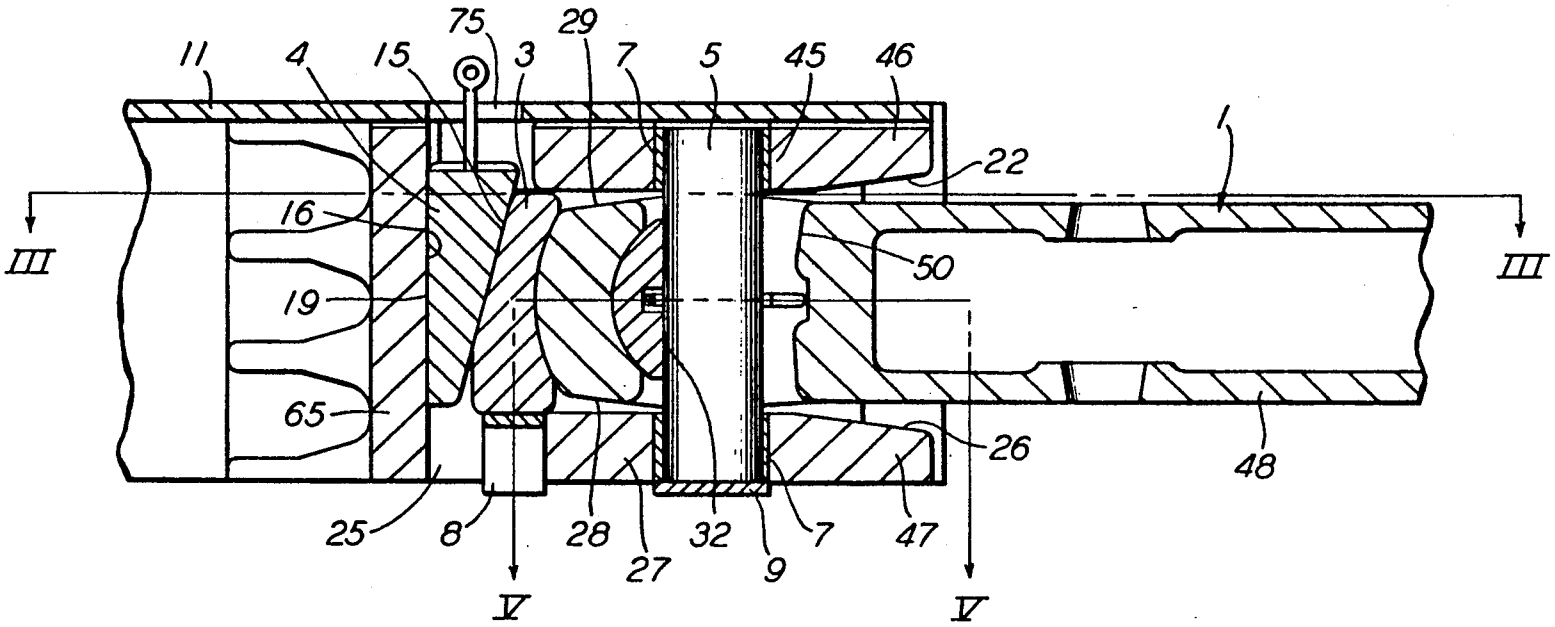
FIG. 4 is a cross-sectional view of the drawbar taken along line IV—IV in FIG. 3.
Figure 5:
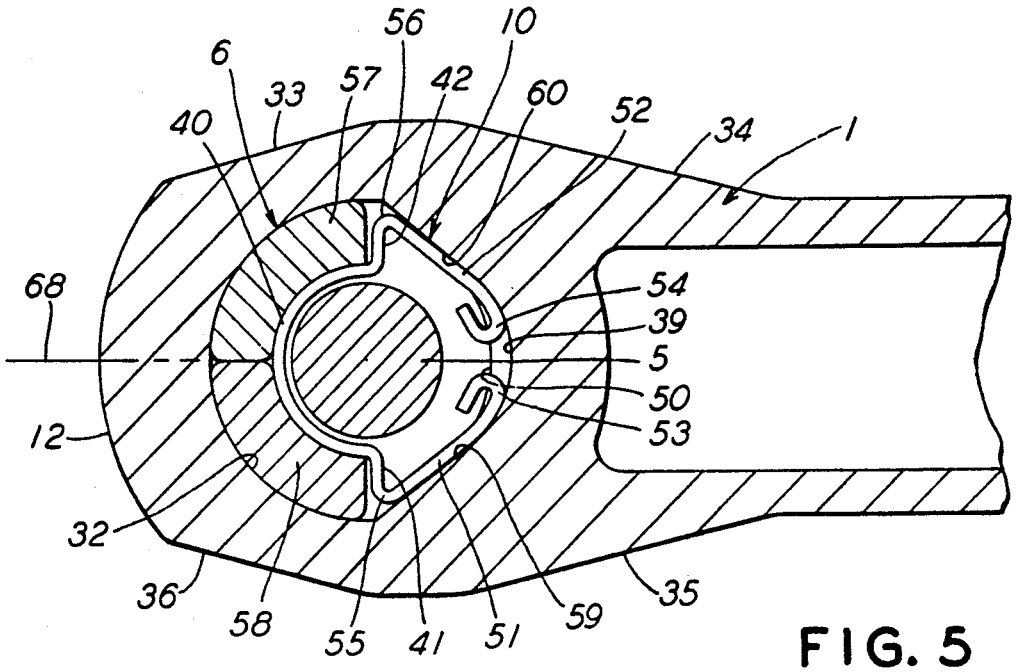
FIG. 5 is a detailed cross-sectional view of the end of the drawbar taken along line V—V in FIG. 4.
Figure 6:
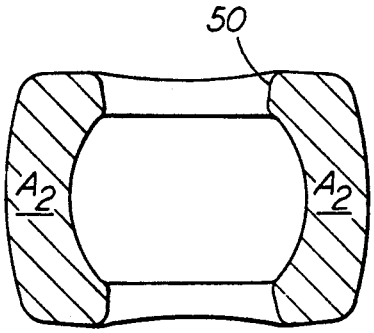
FIGS. 6 and 7 are views taken along lines VI—VI and VII—VII respectively in FIG. 2 showing the cross-sectional area of the drawbar adjacent the opening for the pin.
Figure 7:
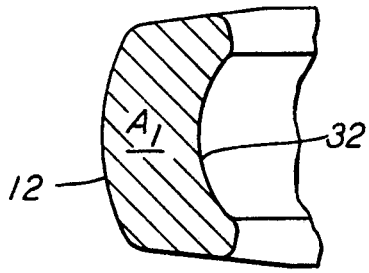

The design of the bearing block 6 and the opening 50 in the drawbar are critical to produce stress and wear characteristics desired. Looking now at FIGS. 1, 2, 4 and 5 it can be seen that bearing block 6 is constructed in two symmetrical quarter-spherical sections 57, 58 retained in annular recess 32 by retaining clip 10. Looking at FIGS. 1, 2, 3, 5 and 6 it can be seen that opening 50 is of generally elliptical shape in cross section transverse to its longitudinal axis and has a generally hemispherical recess 32 for receiving the complementary hemispherical outer surface of bearing block 6. Recess 32 is located in the portion of opening 50 closest to butt end 12 of the slackless drawbar 1. Recess 32 is symmetrically positioned with respect to the longitudinal axis 68 of the slackless drawbar 1 and extends circumferentially more than 90° on either side of axis 68 terminating at points 69 and 70 at the deepest part of recess 32 and at slope transition points 71 and 72 at its intersection with the wall of opening 50. The location of these transition points is important to avoid high stress concentration which could cause failure of the slackless drawbar 1. Turning to FIG. 10 which shows an earlier drawbar system design with a substantially circular opening 150 for the pin and a recess 132 for a bearing block it can be seen that slope transition points 171 and 172 will occur at a point toward the butt end of the drawbar from the center of opening 150. Stress analysis of such a drawbar showed high stress concentration under load at the slope transition points 171 and 172 which could cause fatigue failure of the drawbar. In the preferred embodiment of the present invention, the degree of change of slope at the slope transition point is substantially reduced and the transition point is moved to a less critical area on the side of the center of opening 50 toward intermediate portion 48 of the drawbar and stress concentration at slope transition points 71 and 72 is virtually eliminated.

Figure 8:
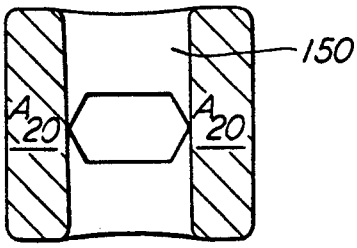
Figure 9:
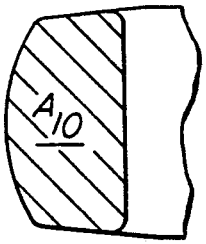

FIGS. 6, 7, 8 and 9 show a comparison of the cross-sectional areas of the butt end and walls of a drawbar adjacent the opening for the pin for a drawbar constructed according to the invention (FIGS. 6 and 7) and a prior art "F" type coupler (FIGS. 8 and 9). The area $A_1$ at the butt end of the drawbar disclosed herein is about 19.10 square inches compared to area $A_{10}$ of the prior art design of about 19.7 square inches. The combined areas of the cross sections $A_2$ adjacent the pin hole or opening 50 of the invention total about 30.00 square inches compared to the combined areas $A_{20}$ of the prior art design of about 24.02 square inches.

Figure 11:
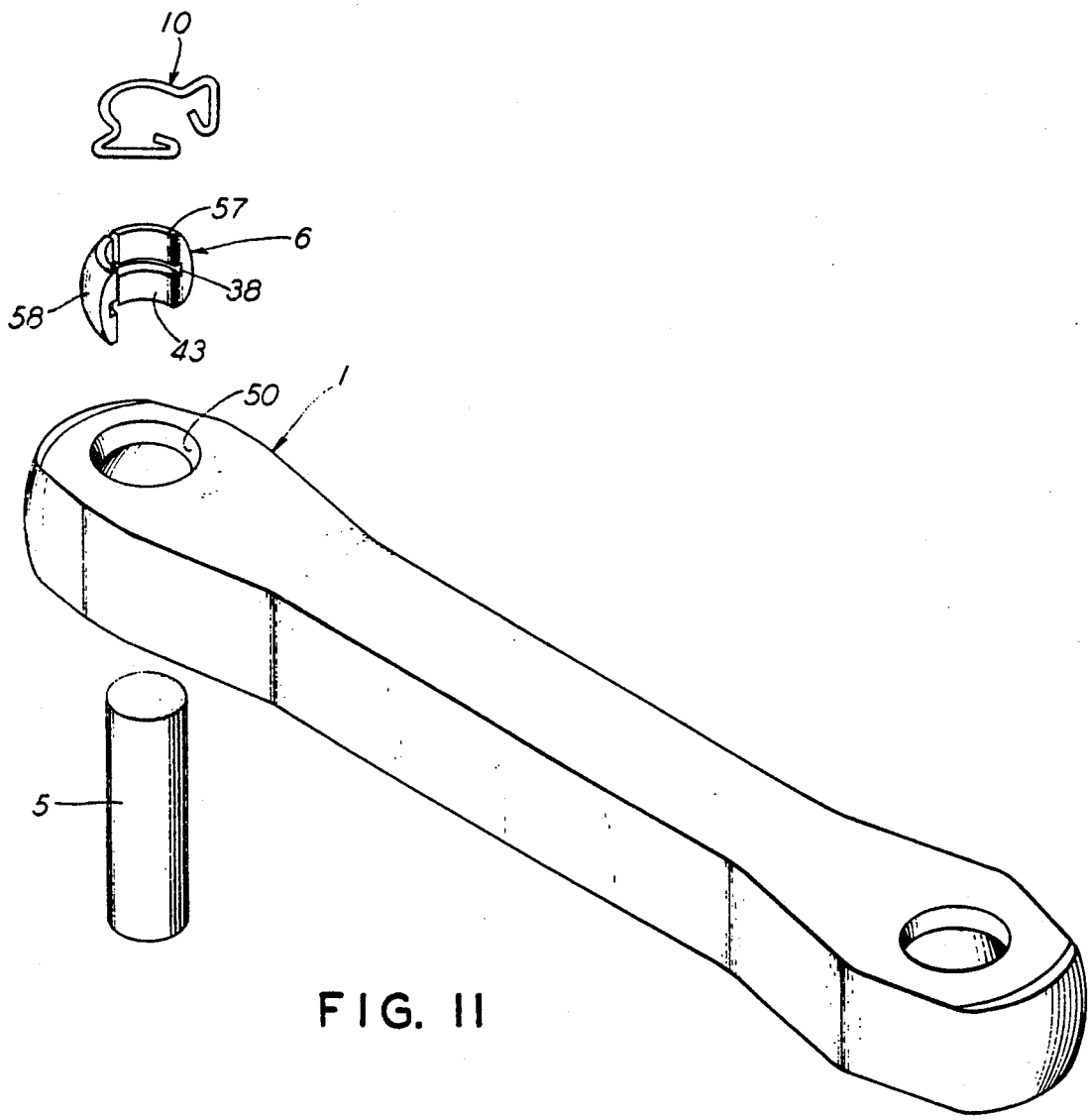
FIGS. 11 and 12 shows two preferred structures of the drawbars.
Figure 12:
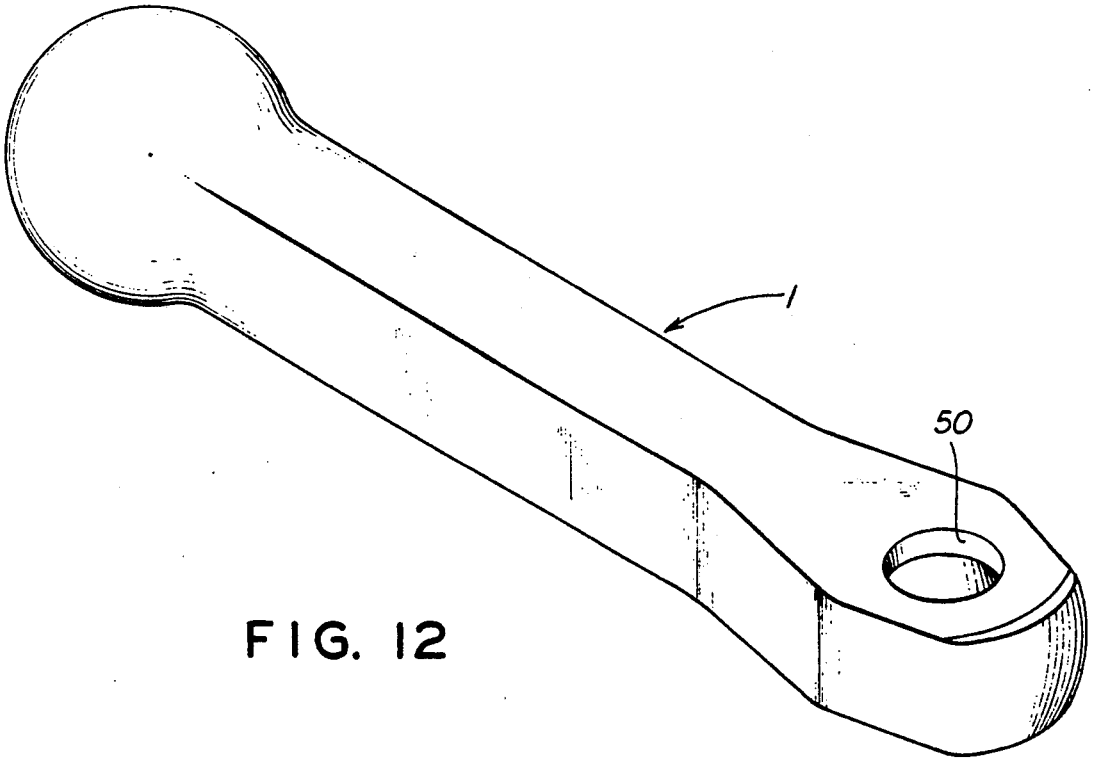

FIG. 11 shows a preferred drawbar having similar structure at both ends thereof. FIG. 12 shows another preferred drawbar having different structures at the ends thereof.

The above characteristics of the drawbar, the use of the bearing block and the selection of material and heat treating procedures all cooperate to provide a greatly improved and advantageous drawbar for a slackless drawbar system.

While the present invention has been described and shown in connection with preferred embodiments, it is apparent that other embodiments may be derived and modifications or changes may be made to the invention as shown and described herein. Therefore the scope of the invention should be construed and limited only in accordance with the appended claims.

We claim:

1. A drawbar for a slackless drawbar system for interconnecting adjacent ends of a pair of adjacent cars in a train, said drawbar comprising:

(a) an elongated bar having a load support portion adjacent its one end for connection to one of such pair of adjacent cars;

(b) a pin receiving opening extending through said load support portion;

(c) a hemispherical recess extending partially around said pin receiving opening; and (d) a pin bearing including at least two individual substantially identical portions supported and retained in said hemispherical recess, each of said at least two of said individual substantially identical portions having an outer surface closely matching a surface of said hemispherical recess and received therein and an inner surface of cylindrical shape to receive a pin therein.

2. A drawbar, as set forth in claim 1, further comprising a retaining clip for retaining said two individual substantially identical portions of said pin bearing in said hemispherical recess.

3. A drawbar, as set forth in claim 2, wherein said drawbar further includes a retaining clip recess extending around that portion of said pin receiving opening not occupied by said hemispherical recess, said retaining clip being receivable in said retaining clip recess.

4. A drawbar, as set forth in claim 1, wherein said hemispherical recess extends over an arc of at least about 180°.

5. A drawbar, as set forth in claim 2, wherein said hemispherical recess and said retaining clip recess are each substantially symmetrically arranged about a longitudinal axis of said drawbar, with said hemispherical recess being adjacent said one end of said elongated bar.

6. A drawbar, as set forth in claim 1, further comprising a butt end of convex configuration at said one end of said elongated bar.

7. A drawbar, as set forth in claim 6, wherein said butt end includes a hardened surface.

8. A drawbar, as set forth in claim 1, wherein said pin bearing is constructed of austempered ductile iron.

9. A drawbar, as set forth in claim 1, wherein said hemispherical recess is substantially symmetrically arranged about a longitudinal axis of said drawbar and is located adjacent said one end of said elongated bar.

10. A drawbar, as set forth in claim 9, wherein said hemispherical recess has a back wall which intersects said pin receiving opening at a slope transition point located more than about 90° from said longitudinal axis of said drawbar measured from said one end of said elongated bar.

11. A drawbar for a slackless drawbar system for interconnecting adjacent ends of a pair of adjacent railway cars in a train, said system including said drawbar, a connecting element securable to one of such pair of adjacent railway cars, a pivot pin connecting said drawbar to said connecting element and ultimately transmitting draft loads from said drawbar to such one of such pair of adjacent railway cars, a follower in contact with said drawbar and having a hemispherical recess, a draft stop for transmitting buff loads from a railway car to said follower, and slack take-up means interposed between said follower and said draft stop, said drawbar comprising:

(a) an elongated bar having a load support portion adjacent a first end, said load support portion having a top first surface and a bottom second surface;

(b) a generally cylindrical pivot pin receiving opening extending through said load support portion from said top first surface to said bottom second surface, said pivot pin receiving opening being flared adjacent a top first end outwardly from its center and upwardly toward said top first surface of said load support portion and being flared adjacent a bottom second end outwardly from its center and downwardly toward said bottom second surface of said load support portion to permit limited rocking about a pivot pin received in said pivot pin receiving opening about an axis transverse to a longitudinal axis of said pivot pin;

(c) a butt end portion of generally hemispherical convex configuration for mating engagement with said hemispherical recess in said follower; and (d) a generally hemispherical recess in said pivot pin receiving opening, substantially symmetrically located with respect to a longitudinal centerline of said drawbar and having a substantially semicircular back wall having a first end and a second end each intersecting said pivot pin receiving opening at a predetermined slope transition points, said slope transition point being located more than 180 degrees from each other along said back wall of said hemispherical recess.

12. A drawbar, as set forth in claim 11, wherein said elongated bar has a second load support portion adjacent a second end axially opposed to its first end and said second load support portion is substantially identical to said load support portion adjacent said first end of said elongated bar.

13. A drawbar, as set forth in claim 12, wherein said load support portion and said second load support portion are connected by an intermediate portion of relatively uniform cross-section.

14. A drawbar, as set forth in claim 13 wherein said intermediate portion is substantially tubular.

15. A drawbar, as set forth in claim 14, wherein said intermediate portion is of rectangular cross-section.

16. A drawbar, as set forth in claim 11, wherein said elongated bar has a second load support portion adjacent a second end axially opposed to its first end and said second load support portion is constructed and arranged to engage with a connecting element on an opposite one of such pair of railway cars which connecting element is of different configuration than said connecting element attached to one of such pair of railway cars.

17. A drawbar, as set forth in claim 11, wherein said top first surface and said bottom second surface converge toward each other as they extend from said pin receiving opening toward said butt end.

18. A drawbar, as set forth in claim 11, wherein a dimensional width of said load support portion of said elongated bar in a direction transverse to its longitudinal axis is greater adjacent said pivot pin receiving opening and symmetrically reduces toward both said butt end and an intermediate portion of said elongated bar, whereby swinging movement of said load support portion about an axis of said pivot pin is facilitated.

* * * * *

UNITED STATES PATENT AND TRADEMARK OFFICE

CERTIFICATE OF CORRECTION

PATENT NO. : 5,207,718

DATED : May 4, 1993

INVENTOR(S) : MaryAnn Glover et al.

It is certified that error appears in the above-identified patent and that said Letters Patent is hereby corrected as shown below:

Column 1, line 24, after 1992 insert --for--.

Column 5, line 11, after cross insert -- - --;

Column 5, line 49, after cross insert -- - --.

Signed and Sealed this

Twenty-eighth Day of December, 1993

*Attest:*

Bruce Lehman

BRUCE LEHMAN

*Attesting Officer*

*Commissioner of Patents and Trademarks*